United States Patent [19]

Marek

[11] 4,199,029

[45] Apr. 22, 1980

[54] MULTIPLE, INDEPENDENTLY ACTUATABLE FIRE SUPPRESSION DEVICES EACH HAVING INDIVIDUAL ACTUATING POWER SOURCE

[75] Inventor: Karl H. Marek, Blue Springs, Mo.

[73] Assignee: Fike Metal Products Corporation, Blue Springs, Mo.

[21] Appl. No.: 895,009

[22] Filed: Apr. 10, 1978

[51] Int. Cl.[2] ..... A62C 37/18

[52] U.S. Cl. ..... 169/61; 169/28; 340/652

[58] Field of Search ..... 169/61, 23, 26, 28, 169/54, 56, 16; 340/652

[56] References Cited

U.S. PATENT DOCUMENTS

| | | | |
|---|---|---|---|
| 3,500,394 | 3/1970 | Egesdal | 340/652 |
| 3,605,901 | 9/1971 | Grabowski et al. | 169/61 |
| 3,664,430 | 5/1972 | Sitabkhan | 169/23 |
| 3,750,161 | 7/1973 | Teeters . | |
| 3,834,463 | 9/1974 | Allard et al. | 169/28 |
| 3,917,001 | 11/1975 | Davis et al. | 169/61 |
| 3,952,809 | 4/1976 | Osborne | 169/61 |

*Primary Examiner*—Charles A. Marmor
*Attorney, Agent, or Firm*—Schmidt, Johnson, Hovey & Williams

[57] ABSTRACT

A fire protection system of the type having a plurality of electrically activatable, parallel coupled fire suppressant units each having a bridge wire type initiating element, produces significantly improved reliability by providing each of the units with an electrically active portion for continuously monitoring the electrical continuity of the associated bridge wire and a discrete capacitive portion for storing an independent, electrical supply of the actuating power therefor, thereby eliminating the dependency of the units on a single, central electrical power supply source while also allowing continuity monitoring of each bridge wire, even though the latter are continuously coupled in parallel relationship with each other. A control circuit associated with each of the suppressant units limits the flow of electrical current in one direction through both the corresponding bridge wire and capacitive portion to a low level in order to effect charging of the latter, but allows a high level current to flow in the opposite direction through the bridge wire upon discharge of the capacitive portion to produce activation of the associated unit. A centrally located, detecting device is operative to sense either the loss of a supervisory current which is allowed to flow through the control lines coupling the units into parallel relationship, due to an open circuit condition in such control lines, or a trouble signal produced by the active portion of one of the releasing units indicating an open circuit condition in the bridge wire associated with an inoperable unit.

19 Claims, 6 Drawing Figures

MULTIPLE, INDEPENDENTLY ACTUATABLE FIRE SUPPRESSION DEVICES EACH HAVING INDIVIDUAL ACTUATING POWER SOURCE

TECHNICAL FIELD

This invention generally relates to fire protection systems and deals more particularly with apparatus having a plurality of electrically activatable, fire suppressant releasing units each provided with an independent activating power source and coupled in parallel relationship with each other, but yet which allows monitoring the operative readiness of each of the releasing units.

BACKGROUND ART

Typical fire protection systems of the kind employed in industrial and similar environments are required to provide for the substantially simultaneous release of a fire suppressant medium into a number of physically displaced portions of an area to be protected, either in automatic response to detection by any one or more sensors of the occurrence of a hazard condition associated with a fire, or in response to a manually executed command. For such purpose, containers of the suppressant medium under pressure are located in the various portions of the area and each is provided with a release valve having an electrically responsive initiator. Because of their fast initiation characteristics and ability to restrain high pressures prior to initiation, the release valves are usually of the rupture disc type having cartridge initiators adapted to fire and rupture the associated valve disc in response to energization of the cartridge with an electrical current having a magnitude in excess of a predetermined threshold value. The electrically responsive initiators each typically comprise a bridge wire element having special, preselected physical characteristics and disposed adjacent a small quantity of an explosive charge. The physical characteristics of the bridge wire are such that the explosive charge is ignited when an electrical current of at least the threshold value is passed through the bridge wire. Upon explosion of the explosive charge, a shock wave is delivered to the release valve which ruptures the disc thereof thereby initiating release of the fire suppressant medium.

In the past, the electrically responsive initiators were coupled in series relationship with each other and with a single source of electrical power for firing each of the initiators. In one sense, this arrangement was desirable since an electrical supervisory current of a magnitude less than the threshold or "firing" value could be passed through each of the initiators in order to monitor the electrical continuity of each of the bridge wires associated with the initiators; in this manner, the operative readiness of each of the initiators could be easily monitored. However, as a result of variations in the physical characteristics of the individual bridge wires associated with the initiators, some of the bridge wires fired more quickly than others resulting in a premature, open circuit in the series loop containing the initiators, thereby resulting in the firing of only a portion of the total number of initiators. More recently, in order to eliminate the aforementioned problem associated with firing the initiators when the latter are coupled in series relationship with each other, circuit means have been devised for normally coupling the initiators in series relationship with each other to allow monitoring the continuity of the bridge wires, but which switches (by means of relays or the like) the initiators into parallel relationship with each other immediately prior to the application thereto of the threshold, or "firing" level of electrical current, thereby assuring that the initiating current is delivered to each of the initiators, even if some of the bridge wires associated therewith are prematurely open circuited. This more recent arrangement for monitoring and firing the initiators was undesirable from the standpoint that additional circuitry including electromechanical components such as relays were required, thus making such systems not only more expensive from a manufacturing standpoint, but also less reliable due to the inclusion of additional circuitry and components. Also, as a further shortcoming of the series-monitor, parallel-fire arrangement for the initiators, it has been found that in some cases, rather than creating an open circuit upon firing, some bridge wires may produce a complete short circuit within an initiator when the threshold electrical current is passed therethrough; under these circumstances, a short circuited initiator located upstream toward the power source in the parallel circuit arrangement may divert the flow of firing current therethrough, thereby precluding the firing of actuators downstream from the short circuited initiator.

Known prior art fire protection systems, of the type described above, typically employ a single, isolated power supply source for providing the threshold level of electrical current to effect firing of the initiators. Such power supply is normally located in a control panel for example, at one end of a circuit configuration containing a plurality of parallel coupled initiators. In the event that the power supply lines connecting the plurality of initiators with the power supply source are short circuited due to a component malfunction or other catastrophy, the resulting short circuit prevents the delivery of the threshold value of electrical current to the initiators thereby disabling the system since the initiators are prevented from firing.

From the foregoing, it is clear that there is a need in the art for a fire protection system which allows continuous monitoring of each of the bridge wires respectively associated with a plurality of parallel coupled, electrically responsive initiators, but whose operation is not thwarted as a result of an unintentional shorting of the circuit which electrically intercouples the initiators for firing.

DISCLOSURE OF INVENTION

The present invention overcomes the aforementioned shortcomings inherent in prior art fire protection system designs by providing apparatus which not only allows monitoring each of the bridge wires respectively associated with a plurality of parallel coupled initiators but also assures that each of the initiators receive the necessary threshold level of electrical current, even in the event of a short circuit either in the circuit lines intercoupling the initiators, or at a main control panel providing a primary source of electrical power. Each of the initiators is electrically coupled in parallel relationship with each other and with a main control panel, which panel includes circuitry for initially supplying each of the initiators with electrical power and is also adapted for monitoring the continuity of the individual bridge wires respectively associated with each of the initiators as well as the electrical control lines intercoupling the initiators. Each of the initiators is provided with an electrically responsive bridge wire element having electrically coupled therewith a control circuit comprising a capacitive device for storing a sufficient quantity of electrical power to produce firing of the corresponding bridge wire, and further includes an active, signal producing device coupled with the corresponding bridge wire element for producing a trouble signal indicative of an open circuit condition in the associated bridge wire. The parallel circuit intercoupling the initiators is provided with an end-of-the-line current limiting impedance which allows a low-level supervisory current to flow through the control lines. In the event that the bridge wire element associated with any of the initiators is open circuited, as a result of deterioration or the like, the active signal producing device is operative to sense such open circuit and produces a marked increase in the magnitude of current flowing through the control lines. A current level detector in the main control panel is operative to sense the increased current level flowing through the control lines produced by the active signal producing means, and is responsive to the detected increase in current level for operating an indicating device to alert personnel of the open circuit condition associated with the defective initiator. In the event that any portion of the control lines normally intercoupling all of the initiators is severed, the substantial decrease in the supervisory current flowing through the circuit is sensed by the detector device in the control panel which, in turn, activates an indicating device to alert personnel to this trouble condition. Simultaneous firing of all of the bridge wire elements is simply and reliably accomplished by short circuiting the control lines to simultaneously discharge each of the storage capacitor devices. Circuit means are further provided to render the apparatus suitable for use in connection with fire protection systems employing a second set of redundant control lines intercoupling the actuator circuits in parallel with each other for additional reliability.

BEST MODE FOR CARRYING OUT THE INVENTION

Figure 1:
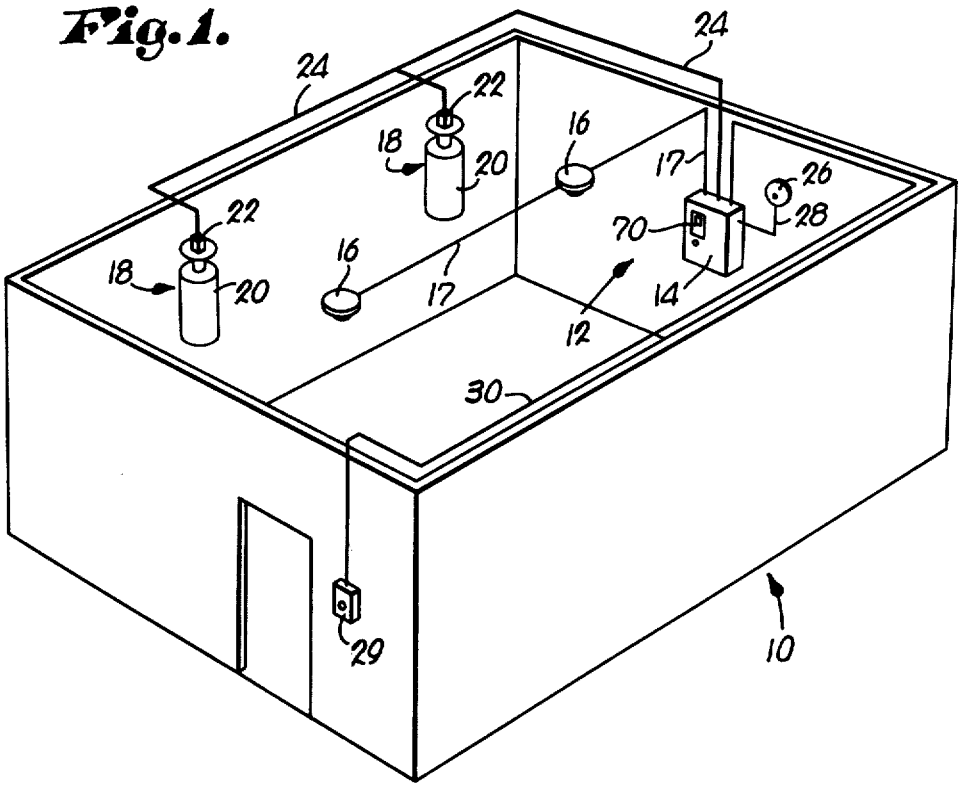
FIG. 1 is an isometric view of a protected room area, diagramatically depicting in operative relationship thereto, certain components of a fire protection system which form a portion of the present invention.

Attention is first directed to FIG. 1 wherein a room 10 defines an area which is desired to be protected against fires by means of a fire protection system generally indicated by the numeral 12 installed therewithin. The fire protection system 12 includes a main control panel 14 which may be situated either outside the room 10 or mounted on an inside wall thereof as shown in FIG. 1. Control panel 14 is adapted to be coupled with a suitable source of electrical power (not shown), such as a 110 volt, A.C. commercial supply and includes appropriate circuitry (not shown) for rectifying and reducing the voltage to a suitable level. A plurality of sensing devices 16 of the known type suitable for early detection of hazardous conditions associated with a fire are strategically disposed at spaced locations within the room 10 and are operably interconnected with each other and with the control panel 14 by means of interconnecting wiring carried within conduit 17.

A plurality of electrically interconnected fire suppressant releasing units 18 are disposed in upper portions of the room 10 at preselected locations within the latter. Each of the releasing units 18 comprises a container portion 20 adapted to hold a quantity of a fire suppressing medium therein, as well as an electrically responsive initiator portion 22 particularly adapted to initiate the corresponding container portion 20 to cause the latter to release a fire suppressing medium for extinguishing a fire within the room 10. Each of the initiator portions 22 includes a later discussed initiator circuit including a bridge wire initiator element, each of the initiator portions 22 being electrically interconnected with each other and with later discussed circuitry within the control panel 14 by means of wiring carried within the protective conduit 24. A visual or audible alarm device, such as the bell 26 is electrically coupled by line 28 to circuitry (not shown) within the control panel 14 and is adapted to indicate either the sensing of a hazard condition by the sensing devices 16, or alternatively, the discharge of the fire suppressing medium by the releasing units 18. A manually operable switch 29 operably coupled with the control panel 14 by electrical line 30 may be mounted within the room 10, or externally thereof as shown in FIG. 1, and is adapted to permit manual actuation of the releasing units 18.

Figure 2:
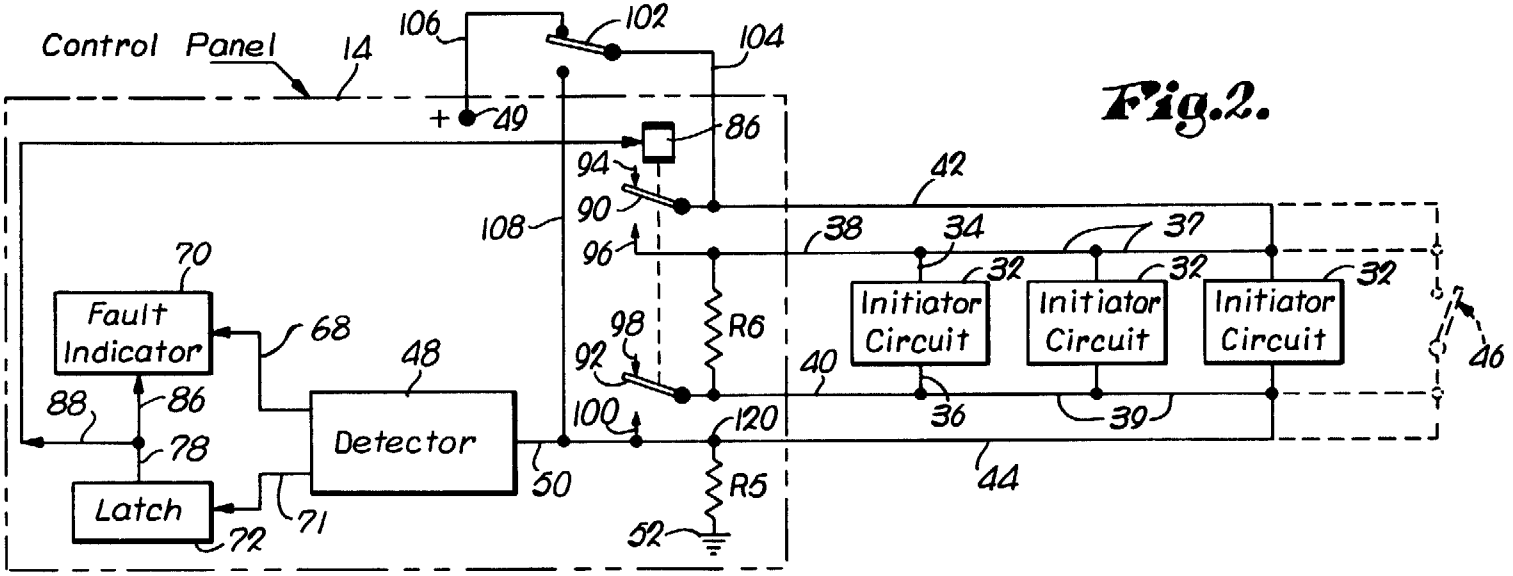
FIG. 2 is a combined schematic and diagramatic representation of a fire protection system including multiple, independently actuatable fire suppression units each having an individual actuating power source, which forms the currently preferred embodiment of the present invention, an optional firing switch being indicated in the phantom.
Figure 3:
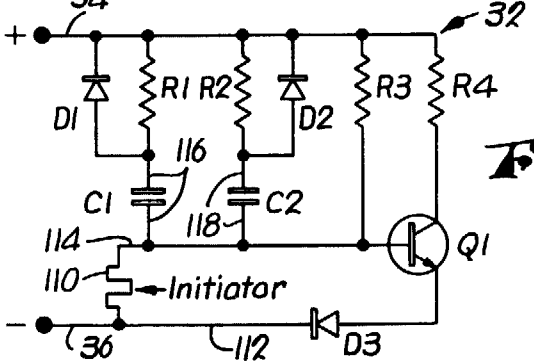
FIG. 3 is a detailed schematic diagram of one of the initiator circuits depicted in FIG. 2.

Referring now also to FIGS. 2 and 3, each of the initiator portions 22 associated with the releasing units 18 includes an associated initiator circuit 32 having the input and output lines thereof respectively designated by the numerals 34 and 36 connected across a pair of distribution lines 37 and 39 respectively, which couple the initiator circuits 32 into parallel relationship with each other. The distribution lines 37 and 39 are in turn coupled with the main control panel 14 by a first set of control lines 42 and 44, as well as by a second set of control lines 38 and 40. A manually operable, actuation switch 46, whose function will become later apparent, may be optionally coupled in parallel relationship across both the first set of control lines 42 and 44, as well as the second set of control lines 38 and 40, or alternatively, between the distribution lines 37 and 39. Control panel 14 includes a detector circuit 48 having the input thereof operably coupled by line 50 to one of the control lines 44 associated with the second set of the latter, as well as to the ground 52 through resistor R5. Detector 48 is especially adapted to function as a "window" detector and is responsive to sense and detect the presence on line 50 of either a first voltage value in excess of a prescribed "safe" range thereof, as well as a second voltage level below such prescribed range.

Figure 5:
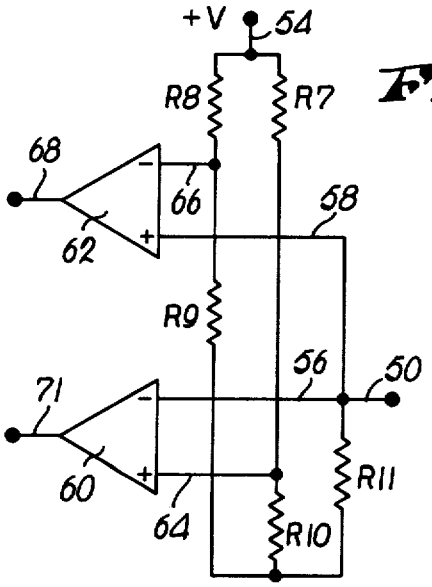
FIG. 5 is a detailed schematic diagram which comprises one form of a circuit suitable for use as the detector shown in FIG. 2.
Figure 6:
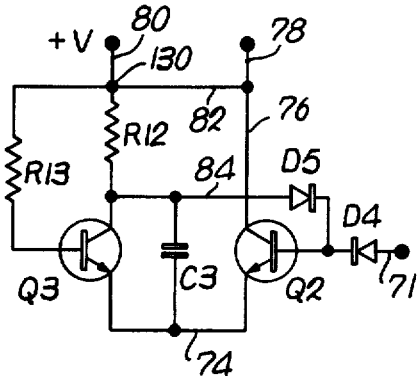
FIG. 6 is a detailed schematic diagram which comprises one form of a circuit suitable for use as the latch shown in FIG. 2.

One suitable circuit for use as the detector 48 is depicted in FIG. 5. An appropriate source of direct current power (not shown) is coupled to the circuit by means of line 54 while the input to the detector 48 comprising line 50 is respectively coupled by lines 56 and 58 to the negative input of a first operational amplifier 60 and a positive input of a second operational amplifier 62. Resistor R7 is connected in series with resistor R10 and form in combination, a voltage divider which is coupled by line 64 to the positive input of operational amplifier 60. Similarly, resistors R8 and R9 form, in combination, a voltage divider which is operably coupled by line 66 to the negative input of operational amplifier 62. Those skilled in the art will readily appreciate that amplifiers 60 and 62 are coupled with the aforementioned voltage divider networks in a manner to perform respective voltage comparing functions. The output of operational amplifier 62 is delivered on line 68 from the detector 48 to a fault indicator 70 which may be located on the face of the panel 14, while the output of operational amplifier 60 is delivered on line 71 from the detector 48 to the input of a suitable latch circuit 72. Fault indicator 70 may comprise any suitable means for audibly or visually alerting operating personnel to a trouble condition in the system. Referring now also to FIG. 6, latch 72 may comprise a pair of transistors Q2 and Q3 respectively having the emitters thereof interconnected by line 74, the base of transistor Q2 forming the input to latch 72 and being operably coupled to line 71 through a blocking diode D4. The collector of transistor Q2 is operably coupled via line 76 to the output of latch 72 which comprises line 78. The base and collector of transistor Q3 are respectively coupled through resistors R13 and R12 to a suitable source of DC power via line 80 as well as to the output lines 78 via line 82. The collector of transistor Q3 is coupled by line 84 through blocking diode D5 to the base of transistor Q2, there being further provided a capacitor C3 operably coupled between lines 74 and 84 to permit resetting of the latch 72 to its quiescent state.

Referring now again more particularly to FIG. 2, the output of latch 72 on line 78 is delivered to the fault indicator 70 by line 86 as well as to the coil portion of a relay device 86 by line 88. Relay coil 86 operates a pair of relay switches 90 and 92, which are respectively switchable between the corresponding contact pairs 94, 96, and 98, 100. A single pole, double throw firing switch 102 has the fixed terminal thereof coupled by line 104 to control line 42, while the movable portion thereof is switchable between line 106 which is coupled to a suitable source of direct current electrical power (not shown), and line 108 which is coupled to both lines 50 and 44. A current limiting resistor R6 is coupled across the first set of control lines 38 and 40 in parallel with each of the initiator circuits 32.

As shown in FIG. 3, each of the initiator circuits 32 may form a discrete control assembly which includes a bridge wire type initiator element 110 which has one side thereof coupled to the output line 36 as well as to the emitter of transistor Q1 by line 112 through the diode D3. The opposite side of initiator element 110 is coupled by line 114 to the base of transistor Q1. An electrical energy storing means in the nature of a capacitor C1 is coupled by line 116 in series with the current limiting resistor R1 to the input line 34, there being provided a diode D1 coupled in parallel with the resistor R1 between line 116 and input line 34 and in series relationship with both the capacitor C1 and initiator element 110. A second electrical energy storing capacitor C2 is coupled in series with a current limiting resistor R2 by line 118 between input line 34 and line 114, in parallel relationship to the series combination of capacitor C1 and resistor R1. A diode D2 is coupled in parallel relationship to resistor R2 between line 118 and input line 34 and in series relationship with capacitor C2 and initiator element 110. A bias resistor R3 is coupled between line 34 and the base of transistor Q1 for biasing the latter's base while a resistor R4 is coupled between input line 34 and the collector of transistor Q1. Capacitors C1 and C2 each possesses a capacity to store a quantity of electrical energy sufficient to produce, upon discharge thereof, an electrical current flow of at least the predetermined threshold magnitude necessary for firing the corresponding initiator element 110.

Turning now to a general description of the operation of the invention, it should first be observed that, under normal conditions with the switch 102 in the position shown in FIG. 2, a supervisory circuit is completed which may be traced from the electrical power source at terminal 49, through line 106, switch 102 and line 104 to lines 42 and 37, through resistor R6 to lines 39 and 44 to ground 52 via resistor R5. Normally then, a supervisory current of a predetermined level is flowing through the control lines 42 and 44 as well as through the distribution lines 37 and 39 at all times unless, of course, an open circuit in such lines interrupts the supervisory current flow. Assuming now that the mentioned control lines 42 and 44, and distribution lines 37 and 39 are in good operating order, let it further be assumed that none of the capacitors C1 or C2 are charged and that the switch 102 has just been moved to the position shown in FIG. 1. With switch 102 in the position described above, current flows through line 104, control line 42, and distribution line 37 into each of the initiator circuits 32 via input lines 34. Current derived from line 34 is delivered through the current limiting resistor R1 thereby charging the capacitor C1, however, the resistive value of resistor R1 is selected in a manner to limit the magnitude of current passing through capacitor C1 into line 114 thence through the initiator 110, to a safe level well below the threshold level of current which will result in the firing of the initiator element 110. The blocking diode D1 prevents current flow from input line 34 through capacitor C1 and initiator element 110 to line 36. In a similar manner, current flows from input line 34 through the current limiting resistor R2 through capacitor C2 thereby charging the latter, and finally, via line 114 through the initiator 110 to line 36. Again however, the resistive value of resistor R2 is sufficient to limit the current flow through capacitor C2 and initiator 110 to prevent firing of the latter. Diode D2 prevents current flow from input line 34 through capacitor C2 and initiator element 110 to line 36, and as previously indicated, resistor R3 merely functions to bias the base of transistor Q1. Assuming that the initiator element 110 is intact, the circuit completed from the emitter of transistor Q1 through the initiator element 110 on line 114 to the base of such transistor short circuits the base to emitter junction thereof and maintains the transistor Q1 in a nonconductive, deenergized state. With both capacitors C1 and C2 undergoing charging, current is delivered to the output line 36 through the initiator element 110 which comprises the sum of current derived from lines 116 and 118. This combined "charging" current flow passing through each of the initiator circuits 32 is combined with the supervisory current flowing through line 39 and is delivered by the latter and by line 44 to ground 52. As will be discussed later in more detail, detector 48 is adapted to sense and detect the presence of its input of a voltage level related to the magnitude of current flowing through resistor R5, either above or below a prescribed range thereof, which range corresponds to a normal, steady-state condition of the system. Thus, a voltage level either in excess of, or below, the prescribed range of normal voltages will indicate any one of several kinds of trouble conditions associated with the initiator circuits 32 or their associated distribution or control lines. Under normal conditions, the supervisory current flowing through resistor R5 will produce a voltage at the input of detector 48 on line 50 which is within such prescribed normal range. During the charging of capacitors C1 and C2, the magnitude of current flow through the initiator elements 110, which is delivered via line 44 through resistor R5 to ground 52, is substantially above the normal steady-state current flow therethrough, however, as previously mentioned, this increased current flow is below the necessary threshold current flow necessary for firing any of the initiator elements 110. The current flow through resistor R5 to ground 52 during charging of each of the capacitors of C1 and C2 increases the voltage level at terminal 120 to a value above the previously mentioned prescribed range of steady-state voltage levels, and is consequently detected by the detector 48. Upon detection of the increase voltage level at terminal 120, the detector 48 produces an output signal on line 68 which is delivered to the input of the fault indicator 70. Fault indicator 70 is energized by the signal on line 68, thereby indicating that the capacitors C1 and C2 are charging. When capacitors C1 and C2 associated with each of the initiator circuits 32 are fully charged, current flow through line 44 and resistor R5 to ground 52 is reduced to the mentioned supervisory current level. Detector 48 is responsive to the reduction in magnitude of the voltage at terminal 120 when the capacitors C1 and C2 are fully charged to deliver a disabling signal on line 68 to the fault indicator 70, thereby deenergizing the latter and affirmatively indicating the operative readiness of the system. In the event that either of the capacitors C1 or C2 associated with any of the initiator circuits 32 becomes defective whereby to permit leakage of current therethrough, such leakage current is combined with the level of mentioned supervisory current, thereby driving the voltage level at terminal 120 above the steady-state normal voltage range whereupon the detector 48 senses such voltage increase and produces an enabling signal on line 68 to actuate the fault indicator 70. From the foregoing then, it is apparent that the detector 48 cooperates with each of the initiator circuits 32 to both indicate that the associated capacitors C1 and C2 are being charged as well as to indicate a defective condition in such capacitors when the latter are fully charged. Moreover, in the event that an open circuit condition occurs at any point in either the control lines 42 and 44 or the distribution lines 37 or 39, the current level through resistor R5 is significantly diminished and the voltage level at terminal 120 drops below the prescribed normal range thereof, whereupon the detector 48 is responsive to actuate the indicator device of such open circuit condition.

Assuming now that the capacitors C1 and C2 associated with each of the initiator circuits 32 is fully charged, and the system is in its normal, steady-state condition, in the event that any of the bridge wire initiator elements 110 is open circuited for any reason, due to deterioration or the like, an open circuit condition is created between line 114 and output line 36 and thus, the base of transistor Q1 is disconnected from the ground 52. Under these circumstances, transistor Q1 is switched to a conductive state allowing current to flow from input line 34 through resistor R4 and diode D3 to line 112 thence to output line 36, and finally to ground 52 by distribution line 39 and control line 44. The resulting current flow through transistor Q1 of any of the initiator circuits 32 having an open circuited initiator element 110 therein is combined with the normal supervisory current flowing in lines 39 and 44, which in turn, escalates the voltage level at terminal 120 above the previously discussed, normal, steady-state range thereof. The resulting escalation of the voltage at terminal 120 is sensed by the detector 48 which is responsive to deliver the enabling signal on line 68 to the fault indicator 70 thereby actuating the latter to affirmatively indicate a trouble condition. Thus, even though each of the initiator circuits 32 is coupled in parallel relationship with each other, the novel circuit arrangement disclosed herein permits the continuous monitoring of each of the bridge wire initiator elements 110 without the need for special circuitry to couple each of the latter in a series configuration.

Assuming now that all of the initiator elements 110 are operative and that the capacitors C1 and C2 associated with each initiator circuit 32 are fully charged, the initiator elements 110 associated with all of the initiator circuits 32 may be simultaneously fired by manual or automatic operation of the firing switch 102. Upon operation of the firing switch 102, line 104 is connected with line 108 thereby completing a short circuit through each of the initiator circuits 32, which may be traced as follows: from one side of each of the initiator circuits 32 coupled by line 37 to line 42, thence on line 104 through switch 102 and line 108 to line 44, and finally to line 39 which intercouples the opposite side of each of the initiator circuits 32. Thus, as best seen in FIG. 3, input line 34 is short circuited with output line 36, thereby allowing the electrical power stored in the capacitors C1 and C2 to flow through the corresponding diodes D1 and D2 into line 34, thence through the short circuit traced above, back through the output line 36 and the bridge wire initiator element 110 to fire the latter. Although a pair of capacitors C1 and C2 are employed in connection with the preferred form of the invention for the purpose of assuring additional reliability of operation, it is to be noted that the use of a single capacitor yields completely acceptable operational results. In any event, it is particularly important to note that, in contrast to prior art systems, the present invention stores a sufficient quantity of electrical energy within each of the initiator circuits 32 to result in the firing of the corresponding bridge wire initiator elements 110 without the need for the delivery of electrical power from a source thereof located in the control panel 14 through any of the control lines to the initiator circuits 32 when it is desired to fire the system. Thus, each of the initiator circuits 32 has its own discrete, independently actuatable supply of electrical power. Moreover, a short circuit created either between the control lines 42 and 44, or control lines 38 and 40, or between distribution lines 37 and 39 does not thwart the operation of the system, as in many prior art designs, but in fact actually assures that the necessary short circuit through each of the initiator circuits 32 is produced, thereby resulting in the discharge of capacitors C1 and C2 through the corresponding bridge wire initiator element 110. In this connection, an alternate firing means comprising the single pole, single throw switch 46 which may be located remote from the control panel 14, may be employed to effectuate the short circuiting of either control line 38 with control line 40 or control line 42 with control line 44. Finally, it is important to observe that bridge wire initiator elements 110 possessing various types of physical characteristics may be employed in the same system since the respectively associated independent power supply sources are carefully matched therewith for firing the same.

As previously discussed, the initiator circuits 32 are normally coupled between a suitable power source at terminal 49 and the ground 52 by the first set of control lines 42 and 44 respectively. However, in the event that an open circuit occurs in either of the control lines 42 or 44, the novel circuit arrangement shown in FIG. 2 is adapted to automatically close and thereby "repair" such open circuit condition in a manner which will now be described. In the event that either or both of the control lines 42 or 44 is severed, the previously discussed supervisory current flow is interrupted and the voltage level at terminal 120 will substantially decrease below the normal steady-state voltage range thereof, and such decreased voltage level is then detected by detector 48. Detector 48 is responsive to the diminished voltage level at terminal 120 to produce an enabling signal on line 71 which is delivered to the input of latch 72. Upon receipt of the signal on line 71, latch 72 is operative to deliver a signal on line 78 to fault indicator 70 via line 86 as well as to the relay coil 86 by line 88. The signal on line 86 activates the fault indicator 70 to affirmatively display the existence of a trouble condition in the system, while the signal on line 88 energizes the normally deenergized relay coil 86. Upon energization, relay coil 86 operates the relay switches 90 and 92 from their normal position shown in FIG. 2 into respective communication with relay contacts 96 and 100. With relay switches 90 and 92 operated to their switched positions as described above, the initiator circuits 32 are recoupled by the second set of control lines 38 and 40 between the firing switch 102 and the ground 52 by means of a circuit path traceable as follows: from firing switch 102 through line 104, through relay switch 90 and contact 96 into lines 38 and 37, thence through each of the initiator circuits 32 into lines 39 and 40, then through relay switch 92 and contact 100 to terminal 120, thence through resistor R5 to ground 52. From the foregoing, it it apparent that even in the event of a break in either or both of lines 42 or 44, the novel circuitry arrangement is adapted to repair the open circuit condition and assure that the system remains in a state of operative readiness for firing while at the same time drawing the attention of operating personnel to the open circuit condition.

Figure 4:
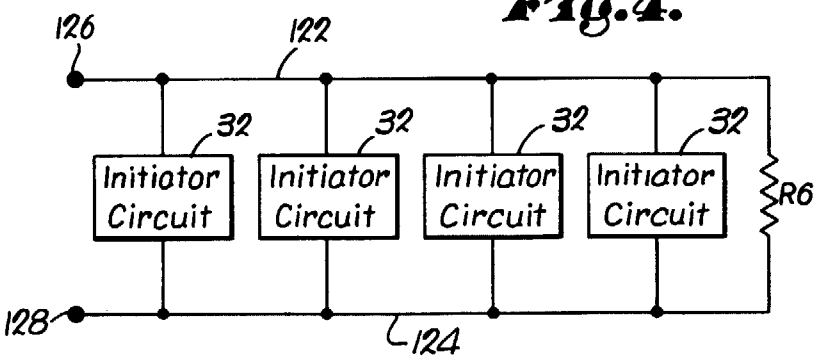
FIG. 4 is a combined schematic and diagramatic representation of an alternate circuit arrangement for intercoupling the initiator circuits.

Although two sets of control lines, 38 and 40 as well as 42 and 44 are depicted in connection with the preferred form of the invention shown in FIG. 2, it is significant to note that the invention is also operable in combination with a single set of control lines 122 and 124 operably intercoupling a plurality of the initiator circuits 32 in electrical parallel relationship, as illustrated in FIG. 4. In connection with the use of the circuit arrangement shown in FIG. 4, the resistor R6 is placed at the end of the line, external of the control panel 14, and the connecting terminals 126 and 128 are respectively coupled to lines 104 and line 50 shown in FIG. 2. In operation, each of the initiator circuits 32 function in a manner exactly as previously described with reference to the circuit arrangement shown in FIG. 2, while the detector 48 is operative to: detect leakage or other defects in the capacitor C1 or C2 associated with any of the initiator circuits 32; continuously monitor the continuity of each of the bridge wire initiator elements 110; and, sense a break in either of the control lines 122 or 124. The use of the circuit arrangement shown in FIG. 4 obviates the need for the use of the latch 72 as well as the relay coil 86 and associated relay switches 90 and 92. With the terminals 126 and 128 respectively coupled with lines 104 and line 50, it can be appreciated that upon operation of the firing switch 102 terminals 126 and 128 will be short circuited by virtue of line 108 which couples line 104 with line 50, thereby short circuiting each of the capacitors C1 and C2 associated with the plurality of initiator circuits 32 to result in firing of the latter.

Turning now to the description of the operation of the detector 48, and referring more particularly to FIGS. 2 and 5, resistors R8 and R9 are selected in a manner to produce a constant reference voltage on the negative input of amplifier 62 on line 66, which reference voltage is normally higher than the voltage on line 58, thereby maintaining the output of amplifier 62 on 68 normally low. However, when the signal level on line 50 which is connected by line 58 to the positive input of amplifier 62 exceeds the reference voltage level on line 66 (as would be the case when one of the initiator elements 110 became open circuited or, when one of the capacitors C1 or C2 allows power leakage therethrough), amplifier 62 is operative to deliver a high signal on its output line 68, which high signal is delivered to one input of fault indicator 70. The value of resistors R7 and R10 are selected in a manner to produce a reference voltage level on the positive input of amplifier 60 on line 64, while the negative input to such amplifier 60 on line 56 normally receives a voltage level above the reference level present on line 64 when the system is in a normal operating state and the mentioned control lines are intact; under these circumstances, the output of amplifier 60 on line 71 is normally low. However, in the event that any of the control lines coupling the initiator circuits 32 in parallel relationship are open circuited, the current flow through resistor R5 to ground 52 is interrupted, in turn diminishing the voltage level on lines 50 and 56. When the voltage on line 56, and hence the negative input to amplifier 60, drops below the reference voltage level on line 64, the amplifier 60 is responsive to deliver a positive high output signal on line 71 to the latch 72. From the foregoing, it can be appreciated that the amplifiers 60 and 62 function as voltage comparators to continuously detect the level of voltage present on line 50 and are respectively responsive to produce output control signals therefrom when the voltage level on line 50 either falls below or rises above a prescribed range of voltages associated with the normal, steady-state operating condition of the system.

Referring now more particularly to FIG. 6 in connection with the operation of the latch 70, under normal operating conditions the voltage at terminal 130, which is connected to the base of transistor Q3 through resistor R13, is sufficient to maintain transistor Q3 in a conductive state, while the absence of a high signal on line 71, which is connected to the base of transistor Q2, maintains the latter in a nonconductive, off state. Upon receipt of a high signal on line 71 from the output of amplifier 60 associated with detector 48, transistor Q2 is turned on thereby reducing the voltage level present at terminal 130 causing the transistor Q3 to turn off. As transistor Q2 is switched to a conducting state, a signal is delivered on line 78 to both the fault indicator 70 and the relay coil 86. However, the signal on line 78 remains present and unchanged even though the signal on line 71 may be removed from the base of transistor Q2, consequently, it may be appreciated that the aforementioned circuitry performs a conventional latching function in connection with the preferred form of the invention to maintain energization of the relay coil 86, even after the relay switches 90, 92 are operated to repair a break in control lines 42 or 44. Similarly, the latch 72 maintains a high signal on line 86 to the fault indicator 70 even after a break in the control lines has been "repaired" as a result of the operation of the relay coil 86 and its associated switches 90 and 92, in order to maintain activation of the fault indicator 70 to affirmatively alert personnel that a break in the control lines has occurred. It is to be noted that other types of latching circuits may obviously be employed with satisfactory results but it is important that the response time for operating the latch 72 is shorter than the response time of the relay coil 86 and switches 90 and 92, since the latter mentioned coil and switches would otherwise "repair" an open circuit condition in control lines 42 and 44 resulting in the detector 48 deactuating the fault indicator 70, before the latter could be "latched" into continued operation.

INDUSTRIAL APPLICABILITY

The present invention provides a fire protection system in which a plurality of electrically responsive fire suppressant releasing units are coupled in parallel relationship to achieve simultaneous firing thereof wherein each of the units includes a separately associated supply of electrical firing power, but which allows the continuous monitoring of each of the bridge wire initiator elements associated with the corresponding unit while also allowing supervision of line breaks in control lines as well as the supervision of the operative readiness of each of the electrical power supplies of the associated unit.

The construction details of the invention have been made amply apparent by the foregoing description, and those skilled in the art will understand that the values of the various components, employed in the illustrated embodiment disclosed herein, may be varied to suit particular operating conditions. Those skilled in the art will be able to assign appropriate values to the various components, however, for the sake of complete understanding, it may be helpful to offer the following table, showing one set of appropriate values, merely by way of example:

| Resistor | Value In Ohms |
|---|---|
| R1 | 2.2 K |
| R2 | 2.2 K |
| R3 | 100 K |
| R4 | 1 K |

-continued

| | |
|---|---|
| R5 | 100 |
| R6 | 4.7 K |
| R7 | 10 K |
| R8 | 22 K |
| R9 | 1.5 K |
| R10 | 150 |
| R11 | 100 |
| R12 | 22 K |
| R13 | 100 K |
| **Capacitor:** | **Value In Microfarads** |
| C1 | 200 |
| C2 | 200 |
| C3 | 0.1 |

The foregoing component values have been found suitable for use in connection with bridge wire type initiator elements having an electrical resistance between 0.2 and 10 ohms.

From the foregoing, it is clear that the invention provides a novel circuit arrangement for a fire protection system which is not only particularly economical from a manufacturing standpoint but which is also exceptionally reliable from an operating standpoint. It is recognized of course, that those skilled in the art may make various modifications or additions to the embodiment chosen to illustrate the invention without departing from the gist and essence of the present contribution to the art. Accordingly, it is to be understood that the protection sought and to be afforded hereby should be deemed to extend to the subject matter claimed and all equivalents thereof fairly within the scope of the invention.

Having thus described the invention, what is claimed as new and desired to be secured by Letters Patent is:

1. In a fire protection system of the type including the combination of a plurality of fire suppressant units each having an individually associated, electrically responsive initiating device provided with an electrical path therethrough and operable for inducing activation of the corresponding suppressant unit upon delivery through said path thereof of at least a predetermined magnitude of electrical current, and a pair of electrical lines coupling the initiating devices in parallel relationship with each other, the improvement which includes:

a plurality of individual, electrical continuity monitoring means, one associated with each of said initiating devices, each of said monitoring means being coupled with said electrical lines and with the path of the corresponding initiating device for continuously monitoring the electrical continuity of said latter mentioned path, each of said monitoring means being operable to produce an electrical fault signal indicative of an open circuit condition in said path of the corresponding initiating device when said latter mentioned path is broken, each of said monitoring means being operable to deliver said fault signal produced thereby through said electrical lines, whereby to allow continuous continuity monitoring of each of said paths associated with said parallel coupled initiating devices; and detection means operably coupled with said electrical lines for sensing said electrical fault signal produced by any of said monitoring means, said detection means including first comparing means adapted for coupling with a source of an electrical reference signal and operable for comparing the magnitude of the latter with the magnitude of said fault signal, said first comparing means being operative to produce an output signal therefrom when the respective magnitudes of said fault signal and said reference signal are in a preselected relationship to each other.

2. The invention of claim 1, wherein said improvement further includes:

an electrical current limiting device operably coupled between said electrical lines and in parallel relationship with each of said initiating devices, said electrical lines being adapted for coupling with an electrical power source to allow an electrical supervisory signal to flow through portions of said electrical lines and through said current limiting device whereby to permit continuous supervision of the circuit integrity of said portions of said electrical lines, said detection means further including second comparing means adapted for coupling with said electrical reference signal source and operable for comparing the magnitude of the latter with the magnitude of said supervisory signal, said second comparing means being operative to produce an output signal therefrom when the respective magnitudes of said supervisory signal and said reference signal are in a preselected relationship to each other.

3. The invention of claim 1, wherein said electrical continuity monitoring means includes an active semiconductor device.

4. The invention of claim 3, wherein:

said active semiconductor device comprises a transistor provided with base, emitter and collector terminals, said electrical path of each associated initiating device being coupled between two of said terminals of the corresponding transistor and normally short circuiting said two terminals to prevent activation of said transistor when said latter mentioned path exhibits electrical continuity therethrough, said transistor being activated to produce said fault signal when the electrical continuity of said path is broken.

5. In a fire protection system of the type including a plurality of fire suppressant releasing units each having an individually associated, electrically responsive initiating device provided with an electrical path therethrough and being operable for inducing activation of the corresponding releasing unit upon delivery through said path thereof of at least a predetermined magnitude of electrical current, the improvement including:

a plurality of individual, controllable, electrical energy storage means, one associated with each of said initiating devices, each of said storage means being electrically coupled with the path associated with the corresponding initiating device, and being operable for storing therein a quantity of electrical energy sufficient to produce said predetermined magnitude of electrical current; and control circuit means operably intercoupling said initiating devices and being adapted for coupling with a source of electrical power, said control circuit means being operable for delivering electrical energy to each of said storage means for storage therein, and being further operable for simultaneously controlling each of said storage means to release said quantity of stored electrical energy therefrom to effect delivery of said predetermined magnitude of electrical current through the corresponding electrical path whereby to reliably assure inducing activation of the associated releasing unit; and a detection device operably coupled with said control circuit means for detecting slow leakage of said stored electrical energy from a defective storage means associated with any of said initiating devices.

6. The invention of claim 5, wherein said control circuit means is adapted for allowing an electrical supervisory signal to flow through portions thereof to permit continuous supervision of the circuit continuity thereof and said detection device is further operable for detecting a break in the circuit continuity of said control circuit means, said detection device including:

first signal comparing means adapted for coupling with a source of a first electrical reference signal and operable for comparing the magnitude of the latter with the magnitude of a signal produced by energy leakage from said defective storage means, said detection device being operative to produce an output signal therefrom when the respective magnitudes of said first references signal and said signal produced by said energy leakage are in a preselected relationship to each other, and second signal comparing means adapted for coupling with a source of a second electrical reference signal and operable for comparing the magnitude of latter with the magnitude of said supervisory signal, said detection device being further operative to produce an output signal therefrom when the respective magnitudes of said second reference signal and said supervisory signal are in a preselected relationship to each other.

7. In a fire protection system of the type including a plurality of fire suppressant releasing units each having an individually associated, electrically responsive initiating device provided with an electrical path therethrough and being operable for inducing activation of the corresponding releasing unit upon delivery through said path thereof of at least a predetermined magnitude of electrical current, the improvement including:

a plurality of individual, controllable, electrical energy storage means, one associated with each of said initiating devices, each of said storage means being electrically coupled with the path associated with the corresponding initiating device, and being operable for storing therein a quantity of electrical energy sufficient to produce said predetermined magnitude of electrical current, each of said storage means including a first capacitor device coupled in series relationship with the corresponding electrical path;

control circuit means operably intercoupling said initiating devices and being adapted for coupling with a source of electrical power, said control circuit means being operable for delivering electrical energy to each of said storage means for storage therein, and being further operable for simultaneously controlling each of said storage means to release said quantity of stored electrical energy therefrom to effect delivery of said predetermined magnitude of electrical current through the corresponding electrical path whereby to reliably assure inducing activation of the associated releasing unit;

a plurality of first current flow limiting means, one associated with each of said initiating devices and each coupled in series relationship with the corresponding path of the associated initiating device and with said first capacitor device for limiting the flow of electrical current through said corresponding path to less than said predetermined magnitude thereof, and a plurality of first unidirectional current blocking means, one associated with each of said initiating devices and each coupled in parallel ralationship with said first current flow limiting means and in series relationship with said first capacitor device, for blocking the flow of said predetermined magnitude of electrical current in one direction through said corresponding path but allowing flow of said predetermined magnitude of electrical current in the other direction therethrough.

8. The invention of claim 7, wherein said improvement further includes:

a plurality of resistive elements, one associated with each of said initiating devices for limiting the flow of electrical current through the corresponding path to less than said predetermined magnitude thereof, each of said resistive elements being coupled in series relationship with said corresponding path and in parallel relationship to the combination of said first current flow limiting means and said first capacitive device of the associated initiating device.

9. The invention of claim 8, wherein said capacitive means further includes a second capacitive device coupled in series relationship to said corresponding path and in parallel relationship to said first capacitive device, said improvement further including:

a plurality of second current flow limiting means, one associated with each of said initiating devices, each coupled in series relationship with the corresponding path and said second capacitive device for limiting the flow of electrical current through said corresponding path to less than said predetermined magnitude thereof, and a plurality of second unidirectional current blocking means, one associated with each of said initiating devices, and each coupled in parallel relationship with said second current flow limiting means and in series relationship with said second capacitive device, for blocking the flow of said predetermined magnitude of electrical current in one direction through said corresponding path but allowing flow of said predetermined magnitude of electrical current in the other direction therethrough.

10. In a fire protection system of the type having a control circuit coupled with a source of electrical power and electrically coupling a plurality of discrete, fire suppression units each electrically activatable to suppress a fire, an electrical initiating circuit for use with each of said suppression units including:

a pair of electrical terminals adapted for coupling with said control circuit;

an electrically responsive initiating element coupled between said terminals and having an electrical path therethrough, said initiating element being operable for inducing activation of the corresponding suppression unit when electrical current of at least a predetermined magnitude is delivered through said path thereof; and electrical energy storage means operably coupled between said terminals and with said initiating element for normally storing therein a quantity of electrical energy sufficient to produce said predetermined magnitude of current, said storage means being responsive to the operation of said control circuit for releasing said quantity of energy stored therein to effect delivery of said predetermined magnitude of electrical current through said electrical path of said initiating device whereby to reliably induce activation of said corresponding suppression unit, said storage means including a capacitive device coupled in series relationship with said electrical path and between said terminals, said capacitive device normally functioning to store said quantity of energy therein and to discharge said stored quantity of energy therefrom when a short circuit condition exists between said terminals;

electrical current flow limiting means coupled in series relationship with said capacitive device and between said terminals for limiting the flow of electrical current through said electrical path to less than said predetermined magnitude thereof whereby to allow electrical charging of said capacitive device but preventing activation of said corresponding suppression unit; and unidirectional current blocking means operably coupled between said terminals, in parallel relationship with said current flow limiting means and in series relationship with said capacitive device and said electrical path, said current blocking means being operable for normally preventing flow of electrical current of said predetermined magnitude thereof in one direction through said electrical path, but allowing said predetermined magnitude of electrical current to flow in the opposite direction through said electrical path when said short circuit condition exists between said terminals.

11. The invention of claim 10, wherein there is further provided:

a resistive element operably coupled between said terminals in electrical series relationship with said electrical path and in parallel relationship with said current limiting means and said capacitive device, said resistive element being operative to prevent flow of said predetermined magnitude of electrical current through said electrical path but allowing a continuity monitoring current of less than said predetermined magnitude thereof to flow between said terminals through said electrical path to permit monitoring the electrical continuity of the latter.

12. In a fire suppression system of the type having a control circuit provided with a source of electrical power and electrically coupling a plurality of discrete fire suppression units, each activatable to suppress a fire, an electrically responsive initiating device for use with each of said suppression units to induce activation of the latter, each of said initiating devices including:

an electrically responsive initiating element having an electrical path therethrough normally exhibiting electrical continuity and being operative to induce activation of the corresponding suppression unit when an electrical current of predetermined magnitude is delivered through said path thereof;

electrical power storage means for normally storing a quantity of electrical energy therein sufficient to produce an electrical current flow through said path of said predetermined magnitude thereof, said storage means being operably coupled with said path and selectively controllable by said control circuit to release said stored quantity of electrical energy therefrom for delivery through said path to induce activation of said corresponding suppression unit; and monitoring means operably coupled with said path for continuously sensing the electrical continuity of said path, said monitoring means being operative upon sensing an open circuit condition in said path to produce an electrical trouble signal indicative of said open circuit condition.

13. The invention of claim 12, wherein:

said storage means includes a capacitive device coupled in series relationship with said path, and said monitoring means includes an active electrical element provided with at least a pair of electrical terminals between which said path is coupled, said active element having a normal deactuated state when said path exhibits electrical continuity whereby to short circuit said pair of terminals, and having an actuated state for producing said trouble signal when said open circuit condition occurs in said path.

14. The invention of claim 13, wherein there is further provided:

current flow limiting means coupled in series relationship with said path and with said capacitive device for limiting the flow of current through said path to less than said predetermined magnitude thereof whereby to allow charging said capacitive device with electrical energy; and unidirectional current flow blocking means coupled in series relationship with said capacitive device and in parallel relationship with said current flow limiting means, said blocking means being normally operative for preventing delivery of said predetermined magnitude of electrical current in one direction through said path, but being further operative upon release of said stored quantity of electrical energy from said storage means for allowing delivery of said predetermined magnitude of electrical current in the opposite direction through said path.

15. The invention of claim 14, wherein said active element comprises a transistor and said pair of electrical terminals respectively comprise the base and emitter of said transistor, there being further provided:

a diode operably coupled between said emitter of said transistor and initiating element for preventing current flow from the latter to the former, and a resistor coupled between the collector of said transistor and said base thereof.

16. A system for suppressing fires in a protected area, including:

a plurality of individual fire suppressant units each activatable to suppress a fire in said area;

a plurality of electrically operable control assemblies, one associated with each of said suppressant units, each of said control assemblies including an initiating device having an electrical path therethrough and being operable to induce activation of a corresponding suppressing unit when said path thereof possesses electrical continuity and an electrical current of at least a predetermined magnitude flows through said path, each of said control assemblies further including electrical continuity monitoring means operably coupled with the respectively associated initiating device for continuously sensing the electrical continuity of the corresponding electrical path, said monitoring means being operable to produce a signal indicative of a trouble condition in said associated initiating device when an open circuit in said corresponding path thereof is sensed, each of said control assemblies further including electrical power storage means operably coupled with said associated initiating device, for storing a quantity of electrical energy sufficient to produce said predetermined magnitude of electrical current;

electrical circuit means for electrically coupling each of said control assemblies into parallel relationship with each other and adapted for coupling with a source of electrical power to allow delivery of the latter to each of said power storage means, said electrical circuit means including electrical switch means for simultaneously controlling each of said power storage means to release therefrom said quantity of electrical energy respectively stored therein and effect flow of said predetermined magnitude of electrical current through the corresponding path of the associated initiating device whereby to induce essentially simultaneous activation of said suppressant units; and electrical detection means operably coupled with said electrical circuit means for detecting said trouble condition signal produced by any of said monitoring means.

17. The invention of claim 16, wherein:

said monitoring means includes an active electrical element provided with at least a pair of electrical terminals coupled with said respectively associated initiating device, said active electrical element having a deactuated state when said corresponding path possesses electrical continuity, and having an actuated state in which said trouble signal is output therefrom when said corresponding path lacks electrical continuity due to an open circuit condition therein, and said electrical power storage means includes a capacitive device coupled in series relationship with said corresponding path.

18. The invention of claim 17, wherein said active electrical element comprises a transistor, and each of said control assemblies further includes:

current limiting means operably coupled with the corresponding electrical path for normally limiting the flow of electrical current through the latter to less than said predetermined magnitude thereof; and unidirectional current blocking means coupled in parallel relationship with said current limiting means for preventing flow of said predetermined magnitude of electrical current in one direction through said corresponding electrical path but allowing said latter mentioned current to flow in the opposite direction through said corresponding electrical path upon release of said quantity of electrical energy from said power storage means.

19. The invention of claim 16, wherein said electrical circuit means includes:

a set of electrical distribution lines having each of said control assemblies coupled therebetween in parallel relationship with each other, a first set of electrical control lines electrically coupling said distribution lines with said switch means, a second set of electrical control lines operably coupled with said distribution lines, electrically actuatable, switchable electrical circuit means operably coupled with said switch means and said second set of control lines for selectively coupling the former with the latter, there being further provided supervisory means operably coupled with said first set of control lines for sensing an open circuit condition in the latter, said supervisory means being further operably coupled with said switchable circuit means and operable for producing an output control signal when an open circuit condition is sensed thereby, said switchable circuit means being responsive to said output control signal to couple said switch means with said second set of control lines.

* * * * *